US010919733B2

(12) United States Patent
Hovi et al.

(10) Patent No.: US 10,919,733 B2
(45) Date of Patent: Feb. 16, 2021

(54) CONFIGURATION APPARATUS AND MAIN SAFETY CIRCUIT FOR AN ELEVATOR SYSTEM AND AN ELEVATOR SYSTEM

(71) Applicant: KONE Corporation, Helsinki (FI)

(72) Inventors: Antti Hovi, Helsinki (FI); Ari Kattainen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 661 days.

(21) Appl. No.: 15/615,502

(22) Filed: Jun. 6, 2017

(65) Prior Publication Data

US 2017/0267496 A1 Sep. 21, 2017

Related U.S. Application Data

(63) Continuation of application No. PCT/FI2015/050857, filed on Dec. 7, 2015.

(30) Foreign Application Priority Data

Dec. 18, 2014 (EP) ..... 14198769

(51) Int. Cl.
*B66B 5/00* (2006.01)
*B66B 13/22* (2006.01)

(52) U.S. Cl.
CPC ..... *B66B 13/22* (2013.01); *B66B 5/0031* (2013.01); *B66B 5/0087* (2013.01)

(58) Field of Classification Search
USPC ..... 187/351
See application file for complete search history.

(56) References Cited

U.S. PATENT DOCUMENTS 7,980,363 B2 * 7/2011 Kattainen ..... B66B 5/0056 187/247
2011/0302466 A1 * 12/2011 Ikawa ..... B66B 1/34 714/704
2013/0041603 A1 2/2013 Sonnenmoser et al.

* cited by examiner

*Primary Examiner* — Christopher Uhlir
(74) *Attorney, Agent, or Firm* — Birch, Stewart, Kolasch & Birch, LLP.

(57) ABSTRACT

According to an aspect of the invention there is provided a configuration apparatus for an elevator system. The configuration apparatus comprises a communication interface configured to enable communication with a main safety circuit of the elevator system via a communication channel; at least one memory configured to store safety configuration data of the elevator system; wherein configuration apparatus is configured to provide via the communication interface at least part of the safety configuration data to the main safety circuit in response to a safety configuration data query.

17 Claims, 2 Drawing Sheets

CONFIGURATION APPARATUS AND MAIN SAFETY CIRCUIT FOR AN ELEVATOR SYSTEM AND AN ELEVATOR SYSTEM

CROSS REFERENCE TO RELATED APPLICATIONS

This application is a Continuation of PCT International Application No. PCT/FI2015/050857, filed on Dec. 7, 2015, which claims priority under 35 U.S.C. 119(a) to patent application Ser. No. 14/198,7693, filed in Europe on Dec. 18, 2014, all of which are hereby expressly incorporated by reference into the present application.

FIELD OF THE INVENTION

The invention relates to elevator systems. More particularly, the invention relates to a safety circuit in an elevator system.

BACKGROUND OF THE INVENTION

An electric safety chain in elevator systems is a common term for an electric safety system of elevators. The safety chain ensures that a running hoisting machine is stopped and that the stopped hoisting machine is not allowed to start when movement of the car or machine could cause harm to persons or to a property. The safety chain is typically independent of other electrical systems like logic control, door control, drive, signalization and alarm system. In a normal operation the safety chain operates in the background and allows the elevator control system to move the car from floor to floor. But if something goes wrong the safety chain activates and the elevator car is stopped.

Devices forming the electric safety chain are called electric safety devices. Electric safety devices may comprise, for example, door locked contacts, car door closed contacts, a pit stop switch, a safety gear switch etc.

Electric safety devices may be, for example, electromechanical contacts with direct opening action. These switches are called safety contacts.

An electric safety device may also be a safety circuit. The safety circuit includes sensors, safety logic and safety output. Safety logic could be built, for example, by using electromechanical relays, electronic components or programmable electronic components. Electromechanical relays are often used to create a safety circuit which bypasses the car door and landing door safety contacts during levelling and relevelling.

Some difficulties may occur when a component that is part of the safety circuit needs to be changed. This also means that the configuration of the safety circuit needs to be restored. Further, a backup of the configuration of the safety component may be stored in a non-safety component. It that case, it is possible that the non-safety component may change the safety circuit configuration.

SUMMARY

According to first aspect of the invention, there is provided a configuration apparatus for an elevator system. The configuration apparatus comprises a communication interface configured to enable communication with a main safety circuit of the elevator system via a communication channel; at least one memory configured to store safety configuration data of the elevator system; wherein the configuration apparatus is configured to provide, via the communication interface, at least part of the safety configuration data to the main safety circuit in response to a safety configuration data query.

In one embodiment the configuration apparatus is configured to receive a periodical safety configuration data query from the main safety circuit of the elevator system.

In one embodiment the configuration apparatus is an active configuration apparatus comprising at least one microcontroller for each communication channel, the at least one microcontroller controlling information exchange via the communication channels.

In one embodiment the configuration apparatus is a passive configuration apparatus configured to allow access by the main safety circuit to the at least one memory.

According to a second aspect of the invention there is provided an elevator system comprising a configuration apparatus according to the first aspect; a main safety circuit configured to connect to the configuration apparatus via a first communication channel and/or a second communication channel; wherein the configuration apparatus is configured to receive configuration data query from the main safety circuit and to provide at least part of the safety configuration data to the main safety circuit.

In one embodiment the main safety circuit is configured to send a periodical safety configuration data query to the configuration apparatus.

In one embodiment the configuration apparatus is a passive configuration apparatus configured to allow access by the main safety circuit to the at least one memory, wherein main safety circuit is configured to access the configuration apparatus via serial communication.

In one embodiment the configuration apparatus is an active configuration apparatus comprising at least one microcontroller controlling information exchange via the communication channel and the main safety circuit is configured to access the configuration apparatus via serial bus communication.

In one embodiment the main safety circuit is configured to enter a safety state, when configuration data received from the configuration data from the configuration apparatus differs from the configuration data stored by the main safety circuit and to prohibit the use of one or more elevators relating to the main safety circuit.

According to a third aspect of the invention there is provided a main safety circuit for an elevator system. The main safety circuit comprises a communication interface configured to connect to a configuration apparatus via a communication channel and at least one processing unit configured to send a configuration data query to the configuration apparatus and to receive safety configuration data from the configuration apparatus.

In one embodiment, the at least one processing unit is configured to send a periodical safety configuration data query to the configuration apparatus.

In one embodiment, the at least one processing unit is configured to control the main safety circuit to enter a safety state, when configuration data received from the configuration apparatus differs from the configuration data stored by the main safety circuit and to prohibit the use of one or more elevators relating to the main safety circuit.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Reference will now be made in detail to the embodiments of the present invention, examples of which are illustrated in the accompanying drawings.

Figure 1:
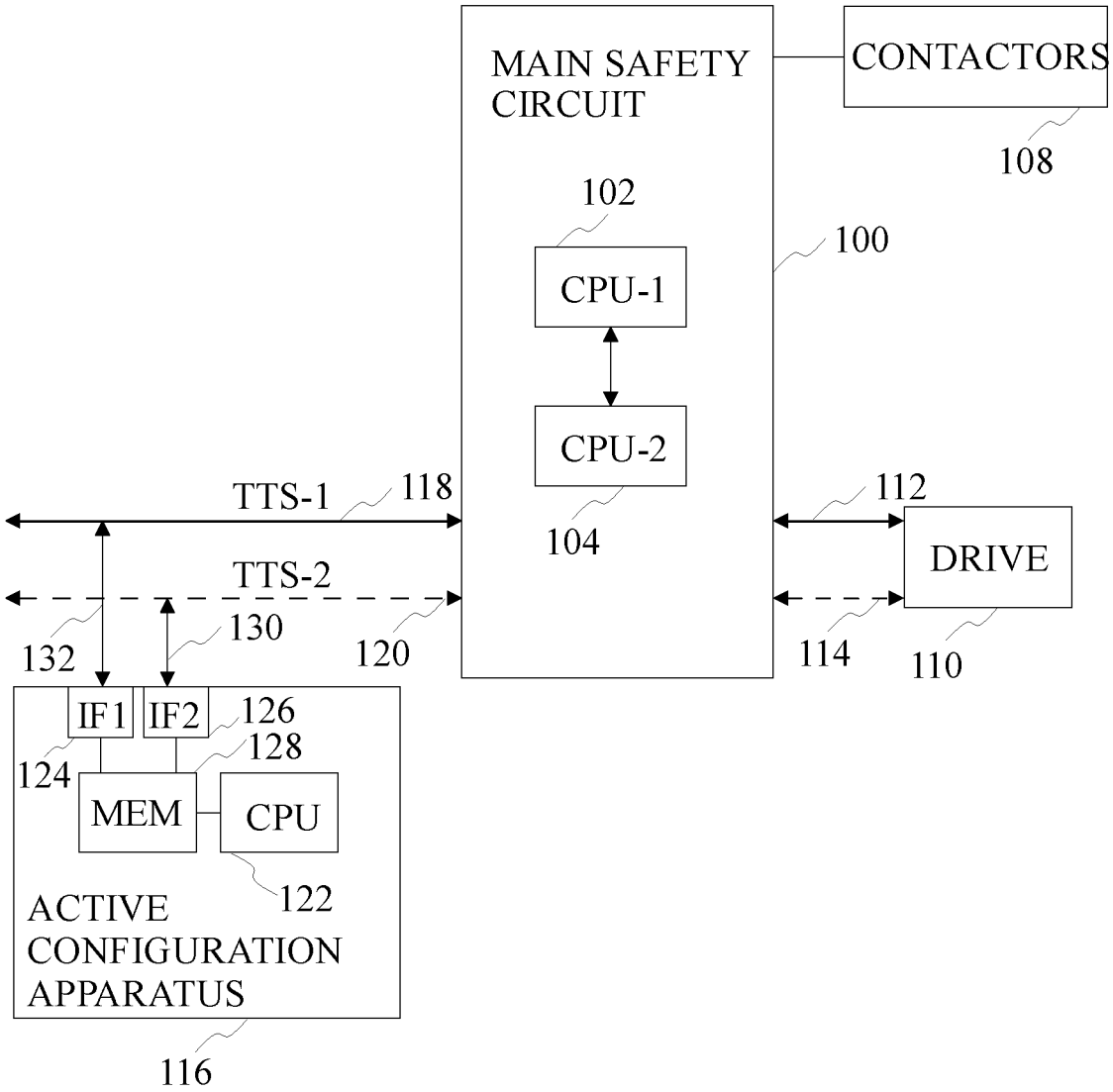
FIG. 1 is a block diagram illustrating a configuration apparatus and an elevator system according to one embodiment of the invention.

FIG. 1 is a block diagram illustrating a configuration apparatus and an elevator system according to one embodiment of the invention.

A main safety circuit 100 is an element in an elevator system that is responsible for safety functions of the elevator system. Although not disclosed in FIG. 1, there may be various elements connected to the main safety circuit 100 that provide various pieces of safety information to the main safety circuit 100. For example, the main safety circuit 100 may receive information relating to door sensors, information from various safety contacts etc. Based on this information the main safety circuit 100 is able to determine whether it is safe to move an elevator car of the elevator system. When the determination has been done to move the elevator car, the main safety circuit 100 instructs contactors 108 to release brakes. Simultaneously, the main safety circuit 100 gives a permission to a drive 110 to move the elevator car.

The main safety circuit may 100 comprise a main processing unit 102. Since the main safety circuit 100 is an essential element of the elevator system and its operability is crucial, the main safety circuit 100 may comprise a redundant processing unit 104. The main processing unit 102 is configured to control communication exchanged via information bus 118 and 112 to other elevator system elements. Similarly, due to redundancy, the redundant processing unit 104 is configured to control communication exchanged via information buses 120 and 114 to other elevator system elements.

In the embodiment of FIG. 1, the elevator system comprises an active configuration apparatus 116. The active configuration apparatus 116 comprises a first communication interface 124 configured to enable communication with the main safety circuit 100 via the information bus 118 and a second communication interface 126 configured to enable communication with the main safety circuit 100 via the information bus 120. References 130 and 132 illustrate connections from the first 124 and second communication interface 126 to the information buses 118, 120. These connections can be implemented using any appropriate technique known to a skilled person.

The active configuration apparatus 116 comprises at least one processing unit 122 configured to control internal operations of the apparatus 116. The processing unit 122 may be a processor, a microcontroller or any other suitable data processing device. The processing unit 122 may also comprise an internal memory or memories.

The active configuration apparatus 116 comprises also memory means 128 configured to store safety configuration data of the elevator system. The stored safety configuration comprises safety configuration data of the safety circuit of the elevator system. This means, for example, that if the main safety circuit 100, a safety controller or any other element relating to the safety circuit need to be replaced due to malfunction, the safety configuration data relating to the replaced element can be copied from the configuration apparatus 116. This also means that if a maintenance person is needed to replace the malfunctioning element, he need not have any knowledge about the safety configuration since the safety configuration relating to the replaced element is copied from the configuration apparatus 116.

The active configuration apparatus 116 is configured to receive, via the first communication interface 124 and/or via the second communication interface 126, a safety configuration data query from the main safety circuit 100. In response to the safety configuration data query, the processing unit 122 retrieves at least part of the stored safety configuration data from the memory 128 and controls the active configuration apparatus 116 to send the retrieved at least part of the stored safety configuration data to the main safety circuit 100 via the first communication interface 124 and/or via the second communication interface 126. In one embodiment, the active configuration apparatus 116 receives the configuration data query from the main configuration circuit 100 periodically, for example, at intervals of seconds or minutes, and preferably around one minute. This ensures that the main safety circuit 100 does not use incorrect safety configuration data.

In one embodiment, if the main safety circuit 100 notices that the safety configuration data in the active configuration apparatus 116 differs from the safety configuration data stored by the main safety circuit 100, the main safety circuit 100 enters a safety state. During the safety state the use of an elevator or elevators relating to the main safety circuit 100 may be prohibited.

The safety configuration data stored by the memory means 128 may be encapsulated. The encapsulation protects the safety configuration data and makes it possible to notice any undesirable change in the safety configuration data.

The active configuration apparatus 116 may comprise a user interface (for example, a display, a button or buttons etc.) via which the functions of the apparatus 116 can be controlled. Further, the active configuration apparatus 116 may comprise a wireless or wired interface via which it is possible to access the functions of the apparatus 116 with a maintenance apparatus.

The memory means 128 may comprise one or memories that can be implemented by any technique that can store data. Alternatively, the memory means 128 may comprise one or more dual in-line package (DIP) switches to indicate the safety configuration or any other means to indicated a safety configuration.

When bus communication is used, all components using the same bus are able to communicate with the active configuration apparatus 116. When the active configuration node 116 connects to the remaining system using a serial bus communication, the connection interface is simple and the active configuration apparatus 116 can be later easily replaced with a new active communication apparatus using, for example, new technology.

Figure 2:
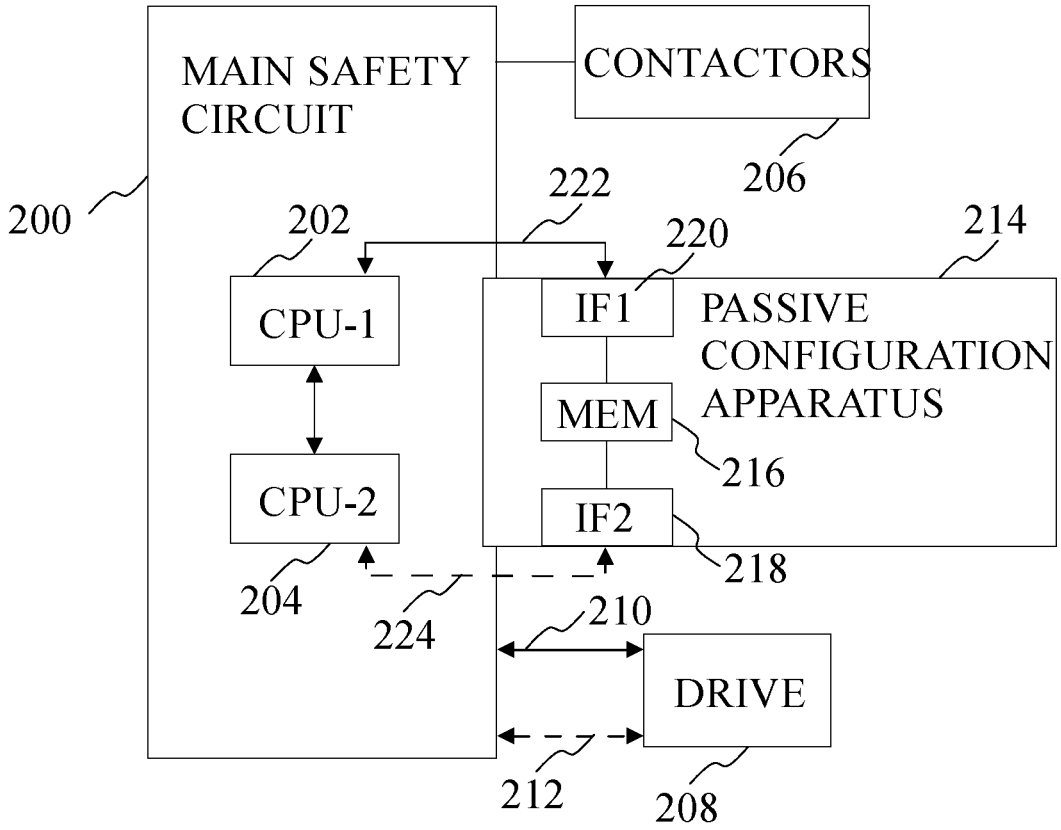
FIG. 2 is a block diagram illustrating a configuration apparatus and an elevator system according to another embodiment of the invention.

FIG. 2 is a block diagram illustrating a configuration apparatus and an elevator system according to another embodiment of the invention.

A main safety circuit 200 is an element in an elevator system that is responsible for safety functions of the elevator system. Although not disclosed in FIG. 2, there may be various elements connected to the main safety circuit 200 that provide various pieces of safety information to the main safety circuit 200. For example, the main safety circuit 200 may receive information relating to door sensors, information from various safety contacts etc. Based on this information the main safety circuit 200 is able to determine whether it is safe to move an elevator car of the elevator system. When the determination has been done to move the elevator car, the main safety circuit 200 instructs contactors 206 to release brakes. Simultaneously, the main safety circuit 200 gives a permission to a drive 208 to move the elevator car.

The main safety circuit may 200 comprise a main processing unit 202. Since the main safety circuit 200 is an essential element of the elevator system and its operability is crucial, the main safety circuit 200 may comprise a redundant processing unit 204. The main processing unit 202 is configured to, for example, control communication exchanged via information bus 210 to a drive 208. Similarly, due to redundancy, the redundant processing unit 204 is configured to control communication exchanged via information bus 212 to the drive 208.

In the embodiment of FIG. 2, the elevator system comprises a passive configuration apparatus 214. The passive configuration apparatus 214 comprises a first communication interface 220 configured to enable communication with the main safety circuit 200 via a data communication link 222 and a second communication interface 218 configured to enable communication with the main safety circuit 200 via a data communication link 224. Information is exchanged via the data communication links 222 and 224 between the main safety circuit 200 and the passive configuration apparatus 214, for example, via serial communication.

The passive configuration apparatus 214 comprises memory means 216 configured to store safety configuration data of the elevator system. The stored safety configuration comprises safety configuration data of the safety circuit of the elevator system. This means, for example, that if the main safety circuit 200, a safety controller or any other element relating to the safety circuit need to be replaced due to malfunction, the safety configuration data relating to the replaced element can be copied from the configuration apparatus 214. This also means that if a maintenance person is needed to replace the malfunctioning element, he need not have any knowledge about the safety configuration since the safety configuration relating to the replaced element is copied from the configuration apparatus 214.

The passive configuration apparatus 214 is configured to receive, via the data communication link 222 and/or 224, a safety configuration data query from the main safety circuit 200. The main safety circuit 200 accesses the memory 216 of the passive configuration apparatus 214 via the first communication interface 220 and/or the second communication interface 224 to read at least part of the safety configuration data stored in the memory 216. In one embodiment, the main safety circuit 200 is configured to periodically access the memory 216, for example, at intervals of seconds or minutes, and preferably around one minute. This ensures that the main safety circuit 200 does not use incorrect safety configuration data.

In one embodiment, if the main safety circuit 200 notices that the safety configuration data in the passive configuration apparatus 214 differs from the safety configuration data stored by the main safety circuit 200, the main safety circuit 200 enters a safety state. During the safety state the use of an elevator or elevators relating to the main safety circuit 200 may be prohibited.

The safety configuration data stored by the memory means 216 may be encapsulated. The encapsulation protects the safety configuration data and makes it possible to notice any undesirable change in the safety configuration data.

In the embodiment of FIG. 2, the main safety circuit 200 accesses information stored in the memory means of the passive configuration apparatus 214 via a direct interface. Thus, in one embodiment, the passive configuration apparatus 214 may be implemented as a re-movable memory card storing the configuration data. The solution disclosed in FIG. 2 using a passive configuration apparatus 214 is simple and easy to implement.

The example embodiments can be included within any suitable device, for example, including any suitable servers, workstations, PCs, laptop computers, capable of performing the processes of the example embodiments, and which can communicate via one or more interface mechanisms. The example embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the example embodiments are not limited to any specific combination of hardware and/or software.

Stored on any one or on a combination of computer readable media, the example embodiments can include software for controlling the components of the example embodiments, for driving the components of the example embodiments, for enabling the components of the example embodiments to interact with a human user, and the like. Such software can include, but is not limited to, device drivers, firmware, operating systems, development tools, applications software, and the like. Such computer readable media further can include the computer program of an example embodiment for performing all or a portion (if processing is distributed) of the processing performed in implementing the example embodiments. Computer code devices of the example embodiments can include any suitable interpretable or executable code mechanism, including but not limited to scripts, interpretable programs, dynamic link libraries (DLLs), Java classes and applets, complete executable programs, and the like. Moreover, parts of the processing of the example embodiments can be distributed for better performance, reliability, cost, and the like.

As stated above, the components of the example embodiments can include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without de-parting from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A configuration apparatus for an elevator system which system includes a main safety circuit that includes safety logic for safely operating the elevator system, the configuration apparatus comprising:

a communication interface configured to enable communication with the main safety circuit of the elevator system via a communication channel;

at least one memory configured to store safety configuration data of the elevator system as a backup for the safety logic of the main safety circuit;

wherein configuration apparatus is configured to provide via the communication interface at least part of the safety configuration data to the main safety circuit in response to a safety configuration data query to facilitate configuration of the main safety circuit when part of the main safety circuit needs to be changed.

2. The configuration apparatus according to claim 1, wherein the configuration apparatus is configured to receive a periodical safety configuration data query from the main safety circuit of the elevator system.

3. The configuration apparatus according to claim 1, wherein the configuration apparatus is an active configuration apparatus comprising at least one microcontroller controlling information exchange via the communication channel.

4. The configuration apparatus according to claim 1, wherein the configuration apparatus is a passive configuration apparatus configured to allow access by the main safety circuit to the at least one memory.

5. An elevator system comprising:

a configuration apparatus according to claim 1; and the main safety circuit configured to connect to the configuration apparatus via the communication channel;

wherein the configuration apparatus is configured to a receive configuration data query from the main safety circuit and to provide at least part of the safety configuration data to the main safety circuit.

6. The elevator system according to claim 5, wherein the main safety circuit is configured to send a periodical safety configuration data query to the configuration apparatus.

7. The elevator system according to claim 5, wherein the configuration apparatus is a passive configuration apparatus configured to allow access by the main safety circuit to the at least one memory, wherein main safety circuit is configured to access the configuration apparatus via serial communication.

8. The elevator system according to claim 5, wherein the configuration apparatus is an active configuration apparatus comprising at least one microcontroller controlling information exchange via the communication channel and the main safety circuit is configured to access the configuration apparatus via serial bus communication.

9. The elevator system according to claim 5, wherein the main safety circuit is configured to enter a safety state, when configuration data received from the configuration apparatus differs from the configuration data stored by the main safety circuit and to prohibit the use of one or more elevators relating to the main safety circuit.

10. The configuration apparatus according to claim 2, wherein the configuration apparatus is an active configuration apparatus comprising at least one microcontroller controlling information exchange via the communication channel.

11. The configuration apparatus according to claim 2, wherein the configuration apparatus is a passive configuration apparatus configured to allow access by the main safety circuit to the at least one memory.

12. An elevator system comprising:

a configuration apparatus according to claim 2;

the main safety circuit configured to connect to the configuration apparatus via the communication channel;

wherein the configuration apparatus is configured to a receive configuration data query from the main safety circuit and to provide at least part of the safety configuration data to the main safety circuit.

13. An elevator system comprising:

a configuration apparatus according to claim 3;

the main safety circuit configured to connect to the configuration apparatus via the communication channel;

wherein the configuration apparatus is configured to a receive configuration data query from the main safety circuit and to provide at least part of the safety configuration data to the main safety circuit.

14. An elevator system comprising:

a configuration apparatus according to claim 4;

the main safety circuit configured to connect to the configuration apparatus via the communication channel;

wherein the configuration apparatus is configured to a receive configuration data query from the main safety circuit and to provide at least part of the safety configuration data to the main safety circuit.

15. The elevator system according to claim 6, wherein the configuration apparatus is a passive configuration apparatus configured to allow access by the main safety circuit to the at least one memory, wherein main safety circuit is configured to access the configuration apparatus via serial communication.

16. The elevator system according to claim 6, wherein the configuration apparatus is an active configuration apparatus comprising at least one microcontroller controlling information exchange via the communication channel and the main safety circuit is configured to access the configuration apparatus via serial bus communication.

17. The elevator system according to claim 6, wherein the main safety circuit is configured to enter a safety state, when configuration data received from the configuration apparatus differs from the configuration data stored by the main safety circuit and to prohibit the use of one or more elevators relating to the main safety circuit.

* * * * *